US007041364B2

(12) United States Patent
Rancien

(10) Patent No.: US 7,041,364 B2
(45) Date of Patent: May 9, 2006

(54) SECURITY PAPER

(75) Inventor: Sandrine Rancien, La Murette (FR)

(73) Assignee: Arjo Wiggins Security Sas, Issy les Moulineaus (FR)

( * ) Notice: Subject to any disclaimer, the term of this patent is extended or adjusted under 35 U.S.C. 154(b) by 30 days.

(21) Appl. No.: 10/451,491

(22) PCT Filed: Dec. 21, 2001

(86) PCT No.: PCT/FR01/04163

§ 371 (c)(1),
(2), (4) Date: Jul. 22, 2003

(87) PCT Pub. No.: WO02/052104

PCT Pub. Date: Jul. 4, 2002

(65) Prior Publication Data

US 2004/0096635 A1 May 20, 2004

(30) Foreign Application Priority Data

Dec. 22, 2000 (FR) ..... 00 16933

(51) Int. Cl.
*B41M 3/14* (2006.01)

(52) U.S. Cl. ..... 428/211.1; 162/125; 283/72; 428/916; 503/200

(58) Field of Classification Search ..... 162/125; 283/72; 428/211.1, 916; 503/200
See application file for complete search history.

(56) References Cited

U.S. PATENT DOCUMENTS 4,833,002 A * 5/1989 Sinclair ..... 428/195.1
6,159,585 A 12/2000 Rittenhouse ..... 428/199

* cited by examiner

*Primary Examiner*—Bruce H. Hess
(74) *Attorney, Agent, or Firm*—Oliff & Berridge, PLC

(57) ABSTRACT

The invention relates to security paper (1) including at least one zone (2; 3) that reacts with nonpolar solvents. The paper also includes a barrier (4) that is impermeable to nonpolar solvents between a first outside face (10) of the security paper and the zone (2; 3) that reacts with the solvents.

25 Claims, 1 Drawing Sheet

SECURITY PAPER

The present invention relates to security paper, and in particular to security paper including at least one zone that reacts to nonpolar solvents.

It is known to incorporate reagents in security paper that is intended in particular for making identity documents, said reagents being designed to produce a colored reaction in the event of the paper being attacked with acids, bases, oxidizing agents, reducing agents, or solvents.

It is also known to incorporate reagents in security papers that give rise to a colored reaction on contact with so-called "polar" solvents such as surgical spirit (90° alcohol) which is often used by forgers in an attempt to remove variable mentions printed on identity documents.

The reagents used for reacting with solvents in general are constituted, for example, by solid particles dispersed in the fiber mass of the security paper and/or in its surface layers, which particles have the feature of being insoluble in water and soluble in certain solvents that are likely to be used by forgers, with the effect of such particles going into solution in the liquid being to color the liquid sufficiently strongly so as to be easily visible to the naked eye under visible light or ultraviolet light.

The face of security papers bearing variable mentions is sometimes covered in a stuck-on transparent protective film that prevents access to said mentions, which film is applied by cold pressure or by heat-sealing.

Forgers are thus tempted to unstick the film so as to falsify the variable mentions by using solvents, and in particular nonpolar solvents.

Similarly, in the context of an application of the visa or security label type, the security paper is coated in adhesive and is then applied to a passport page for receiving visas, or to any other medium that needs to be traced, as appropriate.

Forgers then attempt to unstick such visas or labels using solvents, and in particular nonpolar solvents, in order to be able to use them for some other purpose.

The nonpolar solvents used can be selected, for example, from the following list: white spirit, A spirit (a petroleum distillate in the range 40° C. to 100° C.), kerosene, oil of turpentine, universal synthetic solvent, stain removers such as Eau éclarate®, Zipo® spirit, trichloroethylene, heptane, hexane, Un Du®.

The presence in security paper of reagents capable of reacting with nonpolar solvents raised a difficulty, since the adhesives of protective films or of security papers, generally used in the field of security documents, and in particular acrylic-based adhesives, can include nonpolar substances or residual traces of nonpolar substances, and these nonpolar substances are then liable to react over time with the nonpolar solvent reagents contained in the security paper, thus leading to undesirable coloring of the paper.

That is why known security papers that are intended to come directly into contact with adhesive, do not contain nonpolar solvent reagents, and that is clearly not entirely satisfactory from the point of view of making security documents secure against attempts at falsification.

An object of the present invention is to make security documents more difficult to falsify.

The invention achieves this by novel security paper having at least one zone that reacts with nonpolar solvents, the paper being characterized by the fact that it includes a barrier that is impermeable to nonpolar solvents between a first outside face of the security paper and the zone that reacts with nonpolar solvents.

In other words, the zone that reacts with nonpolar solvents is separated by the barrier from the first outside face of the paper.

By means of the invention, the zone which reacts with nonpolar solvents is sufficiently isolated from the first outside face to allow it to come into contact with an adhesive that contains nonpolar substances or residual traces of nonpolar substances.

The term "zone that reacts with nonpolar solvents" designates that portion of the security paper containing the reagents for dissolving in nonpolar solvents, said portion being constituted, for example, by the fiber mass and/or by a surface layer on the second outside face.

In other words, the invention makes it possible to stick a transparent film or a piece of paper, for example, on the first outside face of the security paper, without that giving rise to the colored reaction in the zone of the security paper that reacts with nonpolar solvents.

The novel security paper of the invention thus makes it possible to provide protection against nonpolar solvents used by forgers in their attempts at falsification.

The reagents for reacting with nonpolar solvents are preferably introduced into a surface layer in the vicinity of the second outside face of the paper opposite from its first outside face, rather than being introduced into the fiber mass, i.e. the zone that reacts with nonpolar solvents, is preferably closer to the second outside face of the paper than it is to the first outside face of the paper.

In the event of an attack using nonpolar solvents performed by soaking or touching the outside face of the security paper opposite from its face on which the transparent film or the paper is stuck, this presents the advantage of giving rise to a colored reaction that takes place more quickly and is more intense.

The other chemical reagents that may be present in the security paper in its fiber mass and/or its surfacing layer are as follows: reagents that react with bases, in particular ammonia or washing soda, reagents that react with acids, in particular hydrochloric acid, reagents that react with oxidizers, in particular sodium hypochlorite or hydrogen peroxide, reagents that react with polar solvents, in particular ethyl alcohol, optionally denatured, these reagents being located independently in the fiber mass or in the surface layers (barrier layer or otherwise) of the paper, depending on the reagents.

Preferably, one of the faces of the security paper includes a mark that is visible to the naked eye and that enables it to be distinguished from the other face, e.g. a watermark.

This makes it easier to avoid sticking a transparent film or a sticky paper by mistake on the second outside face of the security paper which is not protected by the barrier that is impermeable to nonpolar solvents, since otherwise that could lead to a reaction in the zone that reacts with nonpolar solvents.

Preferably, the barrier is situated substantially in the vicinity of the first outside face, thus making it possible, in particular, for the material(s) that is/are impermeable to nonpolar solvents and constituting said barrier to be deposited while applying surface treatment to the fiber mass of the security paper, by surface sizing or coating, on-line or off-line.

The surface processing means used are constituted, for example, by a sizing or coating press, in particular a photogravure press.

The term "barrier situated in the vicinity of the first outside face" means that the barrier is closer to the first outside face than it is to the second.

Thus, between the fiber mass and the barrier or between said barrier and the first outside face, there can exist one or more surfacing and/or printed writing layers.

Materials suitable for use in forming the barrier that is impermeable to nonpolar solvents include the following polymer: polyvinyl alcohol (PVA), in particular a highly film-forming PVA having a very high degree of hydrolysis, e.g. not less than 98%, and having high molecular weight, with the PVA used optionally being carboxylated.

It is also possible to use other polymers, in particular in the form of a stabilized dispersion (synthetic latex), in particular polymers based on acrylic, nitrile, polyvinyl acetate, butadiene styrene, polyvinyl chloride, or indeed other materials, in particular a starch or a fluorine-containing resin, and mixtures thereof.

To reinforce the barrier effect against solvents, it is thus possible to use a mixture comprising a hydrosoluble binder such as starch or PVA together with said latex.

The barrier may be constituted by a surface sizing layer, as mentioned above.

The first outside face of the paper may be in contact with an adhesive, the resulting security paper then constituting, for example, a visa or a security label for sticking on one of the pages of a passport or on a medium that is to be traced.

The invention also provides an assembly comprising security paper as defined above and an adhesive structure stuck to the first outside face of said paper.

Such an adhesive structure may be constituted by an adhesive-coated transparent film, as explained above.

The adhesive structure may also be constituted by a visa paper or a label made using a security paper of the invention, i.e. having at least one zone that reacts with nonpolar solvents, and a barrier that is impermeable to nonpolar solvents, with the adhesive being found in the vicinity of said barrier. Sizing layers and/or printed writing layers may exist between the paper and the adhesive.

Preferably, when the adhesive structure is stuck onto a sizing layer containing a material that is impermeable to nonpolar solvents, the sizing layer is formulated in such a manner that the adhesive force between the adhesive structure and the sizing layer is greater than the adhesive force between the sizing layer and the fiber mass of the security paper, such that in the event of an attempt being made to unstick the adhesive structure, the underlying fiber mass is delaminated.

This ensures that in the event of an attempt being made to unstick the adhesive structure, which structure is constituted for example by a transparent adhesive film as mentioned above, the attempt at unsticking is shown up.

The invention also provides a method of manufacturing security paper in which a mass of papermaking fiber is subjected to differential treatment so as to form a barrier against nonpolar solvents on one face only of said fiber mass.

Other characteristics and advantages of the present invention appear on reading the following detailed description of non-limiting embodiments of the invention, and on examining the accompanying drawing, in which.

The various figures are diagrammatic, and in particular the real relative thicknesses of the various layers are not complied with in order to enable the layers to be distinguished more clearly.

Figure 1:
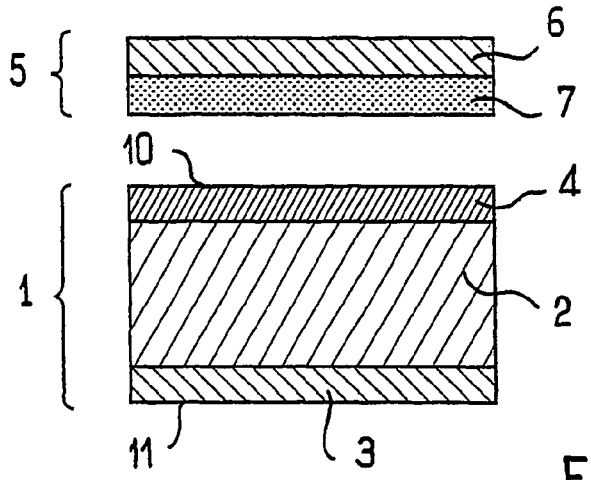
FIG. 1 is a diagrammatic section view of security paper in accordance with the invention together with an adhesive transparent film for sticking on said security paper.

FIG. 1 shows security paper 1 comprising a mass of papermaking fiber 2 having two surface sizing layers 3 and 4 on either side thereof.

FIG. 1 also shows an adhesive transparent film 5 comprising a layer of transparent plastics material 6 and an adhesive layer 7 on one face thereof.

Figure 2:
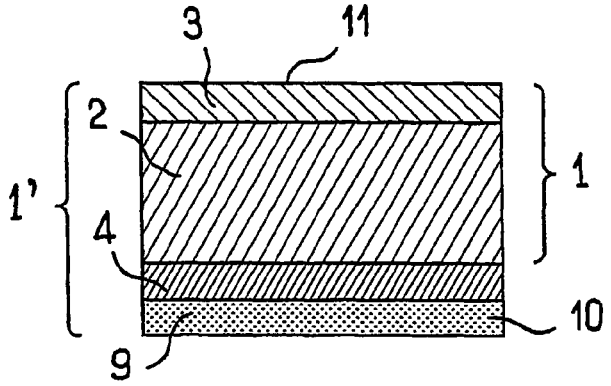
FIG. 2 is a diagrammatic section view of an adhesive structure constituted by security paper in accordance with the invention that presents an adhesive face.

FIG. 2 shows an adhesive structure constituted by adhesive security paper 1' which differs from the paper 1 shown in FIG. 1 by the fact that it carries an adhesive layer 9 on the layer 4.

Figure 3:
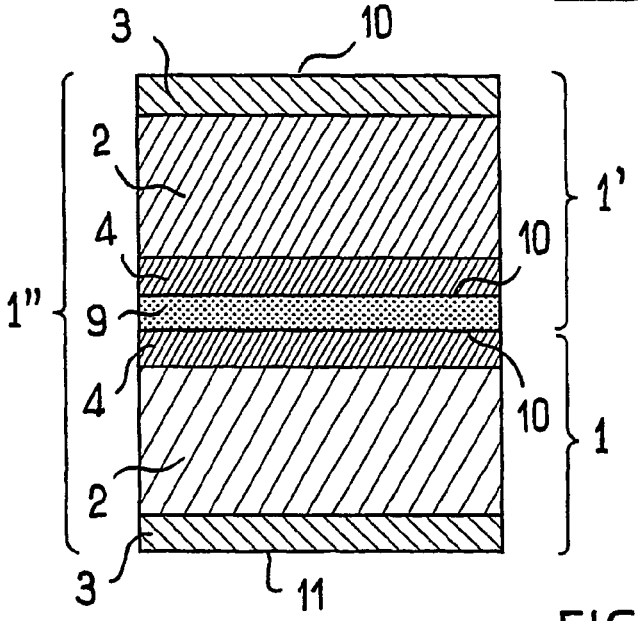
FIG. 3 is a diagrammatic section view of an assembly comprising security paper in accordance with the invention having an adhesive structure in accordance with the invention stuck thereon.

The assembly 1" shown in FIG. 3 is formed by sticking the adhesive structure 1' shown in FIG. 2 on the security paper 1 shown in FIG. 1.

Returning to FIG. 1, the surface sizing layer 4, in accordance with an aspect of the invention, constitutes a barrier which is impermeable to nonpolar solvents, and the fiber mass 2 and/or the surface sizing layer 3 constitute a zone that reacts with nonpolar solvents of the kind used for falsification purposes, i.e. in the example described, they change color in the presence of such solvents.

The outside surface of the layer 4 constitutes the first outside face 10 in the meaning of the invention, while the outside surface of the layer 3 constitutes the second outside face 11.

The fiber mass 2, and the layers 3 or 4 may contain chemical reagents that react with substances other than nonpolar solvents: reagents that react with bases, in particular ammonia or washing soda, reagents that react with acids, in particular hydrochloric acid, reagents that react with oxidizing agents, in particular sodium hypochlorite or hydrogen peroxide, reagents that react with polar solvents, in particular ethyl alcohol, optionally denatured.

The layer 4 includes one or more materials that serve to limit migration of nonpolar substances from the mass of adhesive 7 or 9 through the outside face 10 to the mass of papermaking fibers 2 or the layer of sizing 3 sufficiently to achieve the desired result, such materials being selected, for example, from film-forming PVA having a very high degree of hydrolysis, e.g. equal to 98%, optionally carboxylated, latexes, in particular acrylic-based latexes, or fluorine-containing resins, and mixtures thereof, this list not being limiting in any way.

The use of PVA mixed with an acrylic latex makes it possible to avoid spoiling the mechanical and printing properties that are desired for the security paper 1 or 1' in particular offset printing and smooth cutting.

In order to reveal the effect of the barrier to nonpolar solvents, a sample of security paper has been made using differential treatment consisting in applying sizing layers to the mass of papermaking fiber during the step of treating it in a sizing press, said layers having different compositions on each face.

A sample of security paper has thus been made in which the first sizing layer corresponding to the layer 3 in the example shown in FIG. 1 was made by depositing a bath having the following composition:

10% by weight starch;

1% by weight of an insolublizing agent such as melamine formaldehyde, for cross-linking the starch;

a sufficient quantity of reagents that react with nonpolar solvents, for example 1% by weight; and the remainder being constituted by water.

The barrier-forming sizing layer, corresponding to the layer 4 in the example of FIG. 1, was obtained by depositing a bath having the following composition:

6% by weight PVA hydrolyzed to 98%–99%:

1% by weight styrene acrylate latex; and the remainder being constituted by water.

The solutions of the baths were deposited at 40 grams per square meter ($g/m^2$) while wet in the example described.

A sample was also made for comparison purposes, in which the barrier-forming layer 4 was replaced by a layer identical in composition to the layer 3, but without the reagent that reacts with nonpolar solvents.

An aging test was performed at 80° C. for 24 hours, after sticking an adhesive-coated protective film on the comparison sample and on the sample obtained in accordance with the invention, on its side coated in the layer 4.

The appearance of the two samples was compared at the end of the test.

It was found that colored spots had appeared on the comparison sample whereas the other sample had remained unblemished.

The example shown in FIG. 2 corresponds to a visa type adhesive structure, for example, for sticking via the adhesive mass 9 on a page of a passport, for example.

When the structure is constituted by security paper 1 of the kind shown in FIG. 1, an assembly is obtained as shown in FIG. 3 in which the adhesive mass 9 is contained between two barrier-forming layers 4, and in which the fiber masses 2 or the layers 3 that are capable of reacting with nonpolar solvents are on the outside. The reagents for reacting with nonpolar solvents are preferably introduced in the layers 3 so as to encourage colored reaction occurring when attempts are made to remove the adhesive structure by attacking its surface or while attempts are being made to falsify variable mentions present on the face 10 of the adhesive structure 1'.

Naturally, the invention is not limited to the embodiments described above.

It is possible in particular to use materials forming a barrier against nonpolar solvents other than those described.

The mass of papermaking fiber may comprise cellulose fibers or other fibers, in particular synthetic fibers.

The invention claimed is:

1. Security paper having at least one zone that reacts with nonpolar solvents, the paper including a barrier that is impermeable to nonpolar solvents between a first outside face of the security paper and the zone that reacts with nonpolar solvents.

2. Paper according to claim 1, wherein the zone that reacts with nonpolar solvents is closer to the second outside face of the paper than it is to the first outside face of the paper.

3. Paper according to claim 1, further comprising a fiber mass and a sizing layer, wherein at least one of the fiber mass and the sizing layer includes at least one reagent from the following list: reagents that react with bases, reagents that react with acids, reagents that react with oxidizers, and reagents that react with polar solvents.

4. Paper according to claim 3, wherein the at least one reagent comprises at least one of ammonia or washing soda.

5. Paper according to claim 3, wherein the at least one reagent comprises hydrochloric acid.

6. Paper according to claim 3, wherein the at least one reagent comprises at least one of sodium hypochlorite or hydrogen peroxide.

7. Paper according to claim 3, wherein the at least one reagent comprises ethyl alcohol.

8. Paper according to claim 3, wherein the at least one reagent comprises denaturated ethyl alcohol.

9. Paper according to claim 1, wherein one of the faces of the security paper includes a mark that is visible to the naked eye enabling it to be distinguished from the other face.

10. Paper according to claim 9, wherein the mark is a watermark.

11. Paper according to claim 1, wherein the barrier is situated substantially in the vicinity of the first outside face.

12. Paper according to claim 1, wherein the barrier that is impermeable to nonpolar solvents comprises at least one polymer material.

13. Paper according to claim 11, wherein the polymer material is selected from the following list: polyvinyl alcohol (PVA), a polymer used in the form of a stabilized dispersion (synthetic latex), a fluorine-containing resin, and mixtures thereof.

14. Paper according to claim 11, wherein the barrier comprises a highly film-generating PVA of high molecular weight and very high degree of hydrolysis.

15. Paper according to claim 11, wherein the degree of hydrolysis is equal to or greater than 98%.

16. Paper according to claim 11, wherein the barrier comprises a polymer used in the form of a stabilized dispersion based on acrylic, nitrile, polyvinyl acetate, butadiene styrene or polyvinyl chloride.

17. Paper according to claim 11, wherein the barrier comprises a mixture of a hydrosoluble binder and of a synthetic latex.

18. Paper according to claim 17, wherein the hydrosoluble binder comprises at least one of starch or PVA.

19. Paper according to claim 1, wherein the barrier is constituted by a layer of sizing.

20. Paper according to claim 1, wherein the first outside face of the paper is in contact with an adhesive.

21. An assembly comprising a security paper as defined in claim 1 together with an adhesive structure stuck on the first outside face of said paper.

22. An assembly according to claim 21, wherein the adhesive structure is constituted by an adhesive-coated transparent film.

23. An assembly according to claim 21, wherein the adhesive structure is constituted by a visa paper or an adhesive-coated label.

24. An assembly according to claim 21, wherein the adhesive structure is stuck on a layer of sizing containing a material that is impermeable to nonpolar solvents, said layer of sizing being formulated in such a manner than the adhesive force between the adhesive structure and the layer of sizing is greater than the adhesive force between the layer of sizing and the fiber mass of the security paper, thus ensuring that during an attempt to unstick the adhesive structure, delamination occurs in the underlying fiber mass.

25. A method of manufacturing security paper according to claim 1, in which sizing layers are applied to a mass of papermaking fiber in a sizing press, the sizing layers having different compositions on each face of the fiber mass so as to form a barrier to nonpolar solvents on only one face of the fiber mass.

* * * * *